US011335147B2

(12) United States Patent
Long et al.

(10) Patent No.: US 11,335,147 B2
(45) **Date of Patent: *May 17, 2022**

(54) DYNAMIC POWER MANAGEMENT FOR ELECTRONIC LOCKSETS

(71) Applicant: Schlage Lock Company LLC, Carmel, IN (US)

(72) Inventors: Joshua A. Long, Greenwood, IN (US); Joseph W. Baumgarte, Carmel, IN (US); John Luif, Lakewood, CO (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/088,244

(22) Filed: Nov. 3, 2020

(65) Prior Publication Data

US 2021/0118254 A1 Apr. 22, 2021

Related U.S. Application Data

(63) Continuation of application No. 16/781,500, filed on Feb. 4, 2020, now Pat. No. 10,825,276, which is a (Continued)

(51) Int. Cl.
*G07C 9/00* (2020.01)
*E05B 47/00* (2006.01)

(Continued)

(52) U.S. Cl.
CPC ..... *G07C 9/00817* (2013.01); *E05B 47/00* (2013.01); *E05B 55/005* (2013.01); *G07C 2009/00825* (2013.01)

(58) Field of Classification Search
CPC ..... G07C 9/00817; G07C 2009/00825; E05B 47/00; E05B 55/005
See application file for complete search history.

(56) References Cited

U.S. PATENT DOCUMENTS 5,252,966 A * 10/1993 Lambropoulos ... G07C 9/00182 340/5.64
7,813,822 B1 * 10/2010 Hoffberg ..... H04N 21/44222 700/94

(Continued)

OTHER PUBLICATIONS

International Search Report; International Searching Authority; International Application No. PCT/US2020/017029; dated May 27, 2020; 3 pages.

(Continued)

*Primary Examiner* — Thomas D Alunkal
(74) *Attorney, Agent, or Firm* — Taft Stettinius & Hollister LLP

(57) ABSTRACT

An exemplary embodiment pertains to a method of operating an electronic lockset during a plurality of iterations of a recurring period of time, wherein the electronic lockset includes a first electronic component. The method generally includes generating a usage score for the electronic component based on usage of the electronic lockset during the first iteration of the recurring period of time, selecting a schedule for the electronic component based on the first usage score, and during a second iteration of the recurring period of time occurring after the first iteration of the recurring period of time, operating the electronic component operating according to the selected schedule.

20 Claims, 5 Drawing Sheets

Related U.S. Application Data continuation of application No. 16/268,699, filed on Feb. 6, 2019, now Pat. No. 10,553,059.

(51) Int. Cl.
*E05B 5/00* (2006.01)
*E05B 55/00* (2006.01)

(56) References Cited

U.S. PATENT DOCUMENTS

| | | | | |
|---|---|---|---|---|
| 9,319,993 | B1 * | 4/2016 | Urbanus | H04W 52/0258 |
| 9,733,991 | B2 * | 8/2017 | Ash | G06F 12/0866 |
| 10,553,059 | B1 * | 2/2020 | Long | G07C 9/00817 |
| 10,825,276 | B2 * | 11/2020 | Long | G07C 9/00174 |
| 2006/0139148 | A1 * | 6/2006 | Faro | G07C 9/27 340/5.73 |
| 2006/0139149 | A1 * | 6/2006 | Faro | G07C 9/38 340/5.73 |
| 2012/0311141 | A1 | 12/2012 | Durazzo et al. | |
| 2014/0082296 | A1 | 3/2014 | Ash et al. | |
| 2015/0145643 | A1 * | 5/2015 | Fadell | G07C 9/27 340/5.51 |
| 2015/0370307 | A1 | 12/2015 | Sullivan et al. | |
| 2017/0295545 | A1 * | 10/2017 | Zacchio | H04W 52/0229 |

OTHER PUBLICATIONS

Written Opinion of the International Searching Authority; International Searching Authority; International Application No. PCT/US2020/017029; dated May 27, 2020; 6 pages.

* cited by examiner

DYNAMIC POWER MANAGEMENT FOR ELECTRONIC LOCKSETS

CROSS-REFERENCE TO RELATED APPLICATIONS

The present application is a continuation of U.S. patent application Ser. No. 16/781,500 filed Feb. 4, 2020 and issued as U.S. Pat. No. 10,825,276, which is a continuation of U.S. patent application Ser. No. 16/268,699 filed Feb. 6, 2019 and issued as U.S. Pat. No. 10,553,059, the contents of which are incorporated herein by reference in their entirety.

TECHNICAL FIELD

The present disclosure generally relates to electronic locksets, and more particularly but not exclusively relates to methods of controlling such locksets.

BACKGROUND

Certain electronic locksets include a variety of electronic components that require electrical power to operate, such as wireless transceivers, cameras, and digital displays. Currently, most such locksets operate the electronic components according to a set schedule, for example by keeping the electronic components on at all times. However, such operation can cause the lockset to consume significantly more power than is strictly necessary, which is of particular concern when the lockset is powered by an onboard power supply, such as a battery. For these reasons among others, there remains a need for further improvements in this technological field.

SUMMARY

An exemplary embodiment pertains to a method of operating an electronic lockset during a plurality of iterations of a recurring period of time, wherein the electronic lockset includes a first electronic component. The method generally includes generating a usage score for the electronic component based on usage of the electronic lockset during the first iteration of the recurring period of time, selecting a schedule for the electronic component based on the first usage score, and during a second iteration of the recurring period of time occurring after the first iteration of the recurring period of time, operating the electronic component operating according to the selected schedule. Further embodiments, forms, features, and aspects of the present application shall become apparent from the description and figures provided herewith.

DETAILED DESCRIPTION OF ILLUSTRATIVE EMBODIMENTS

Figure 1:
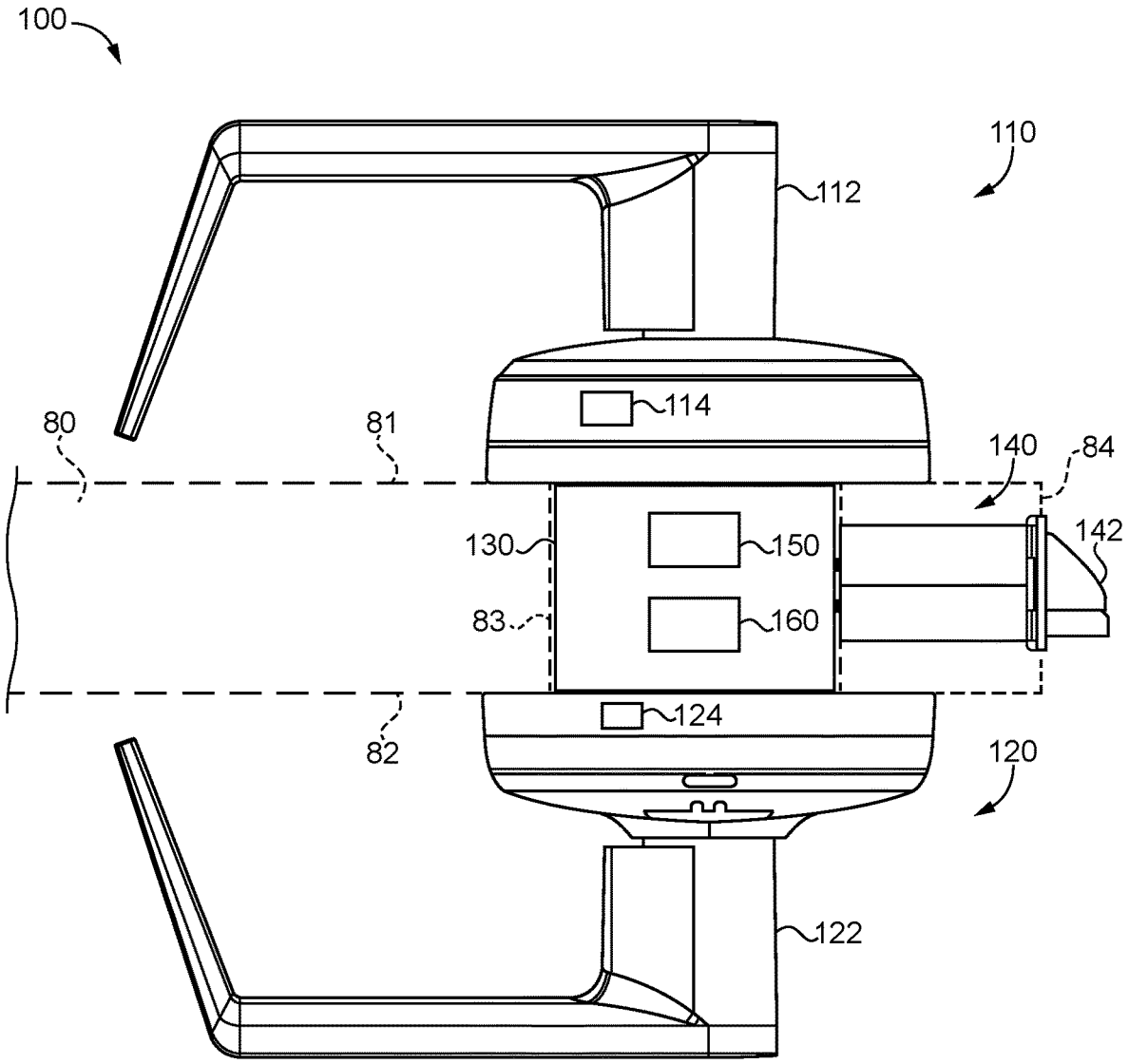
FIG. 1 is a schematic plan view of a lockset according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown certain in specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media devices).

With reference to FIG. 1, illustrated therein is an access control device in the form of a lockset 100 according to certain embodiments. The lockset 100 is mounted to a door 80, and generally includes an inside assembly 110 mounted to an inner side 81 of the door 80, an outside assembly 120 mounted to an outer side 82 of the door 80, a chassis 130 mounted within a cutout 83 of the door 80 and connected with the inside assembly 110 and the outside assembly 120, and a bolt mechanism 140 operably connected with the chassis 130 and operable to extend beyond a swinging edge 84 of the door 80. The lockset 100 further includes an electronically-operable locking mechanism 150 having a locking state and an unlocking state, and a control assembly 160 operable to transition the locking mechanism 150 between the locking state and the unlocking state.

The inside assembly 110 includes an inside actuator 112 that is operably connected to the chassis 130 such that the inside actuator 112 is at least selectively operable to actuate the bolt mechanism 140. In the illustrated form, the inside actuator 112 is provided in the form of a handle, and more particularly as a lever. In other embodiments, the inside actuator 112 may be provided in another form, such as that of a knob, a thumbturn, or a pushbar mechanism. The inside assembly 110 further includes a lock state selector 114 operable to transition the lockset 100 between a locked state and an unlocked state. In certain forms, the lock state selector 114 may be a mechanical lock state selector that physically drives the locking mechanism 150 between its locking state and its unlocking state. In other forms, the lock state selector 114 may be an electronic lock state selector that is in communication with the control assembly 160 and is operable to cause the control assembly 160 to transition the locking mechanism 150 between its locking state and its unlocking state.

The outside assembly 120 includes an outside actuator 122 that is operably connected to the chassis 130 such that the outside actuator 122 is selectively operable to actuate the bolt mechanism 140. In the illustrated form, the outside actuator 122 is provided in the form of a handle, and more particularly as a lever. In other embodiments, the outside actuator 122 may be provided in another form, such as that of a knob, a thumbturn, or a lock cylinder. The outside assembly 120 may further include a credential reader 124 in communication with the control assembly 160. The credential reader 124 may, for example, take the form of a card reader, a keypad, or a biometric credential reader. During operation of the lockset 100, presentation of an appropriate credential to the credential reader 124 (e.g., by inputting a code or presenting a card, a fob, or a biometric input) causes the control assembly 160 to transition the locking mechanism 150 from the locked state to the unlocked state.

The chassis 130 is mounted within the door cutout 83 and at least selectively connects each of the actuators 112, 122 with the bolt mechanism 140. The chassis 130 may, for example, take the form of a mortise-format chassis, a cylindrical-format chassis, or a tubular-format chassis, the features of which will be readily apparent to those skilled in the art. The chassis 130 has a locked state and an unlocked state. In the unlocked state, the chassis 130 maintains the bolt mechanism 140 in a retracted state and/or permits the outside assembly 120 to retract the bolt mechanism 140. In the locked state, the chassis 130 maintains the bolt mechanism 140 in an extended state and/or prevents the outside assembly 120 from retracting the bolt mechanism 140. The chassis 130 may be transitioned between the locked state and the unlocked state by the electronic locking mechanism 150.

The bolt mechanism 140 includes a bolt 142 having an extended position and a retracted position. With the bolt 142 in the extended position and the door 80 in the closed position, the bolt 142 extends into the doorframe and retains the door 80 in the closed position. When the bolt 142 is retracted, the door 80 is free to move from the closed position to the open position. In the illustrated form, the bolt mechanism 140 is provided in the form of a latchbolt mechanism, and includes a spring-loaded latchbolt 142 that is biased toward its extended position. In other forms, the bolt mechanism 140 may be provided in the form of a deadbolt mechanism, and may include a bolt 142 in the form of a deadlocking deadbolt. Additionally, while the illustrated bolt mechanism 140 is provided adjacent the chassis 130, it is also contemplated that the bolt mechanism 140 may be positioned remotely from the chassis 130.

The electronic locking mechanism 150 may be mounted within the chassis 130, and has an unlocking state in which the door 80 can be opened from the outer side 82 (e.g., by operating the outside actuator 122 and/or pulling the door 80 toward its open position), and a locking state in which the door 80 cannot be opened from the outer side 82. In the illustrated form, the locking mechanism 150 prevents the outside actuator 122 from actuating the bolt mechanism 140 when in the locking state, and permits the outside actuator 122 to actuate the bolt mechanism 140 when in the unlocking state. In other forms, the locking mechanism 150 may retract the bolt 142 when transitioned from the locking state to the unlocking state, and may extend the bolt 142 when transitioned from the unlocking state to the unlocking state.

Figure 2:
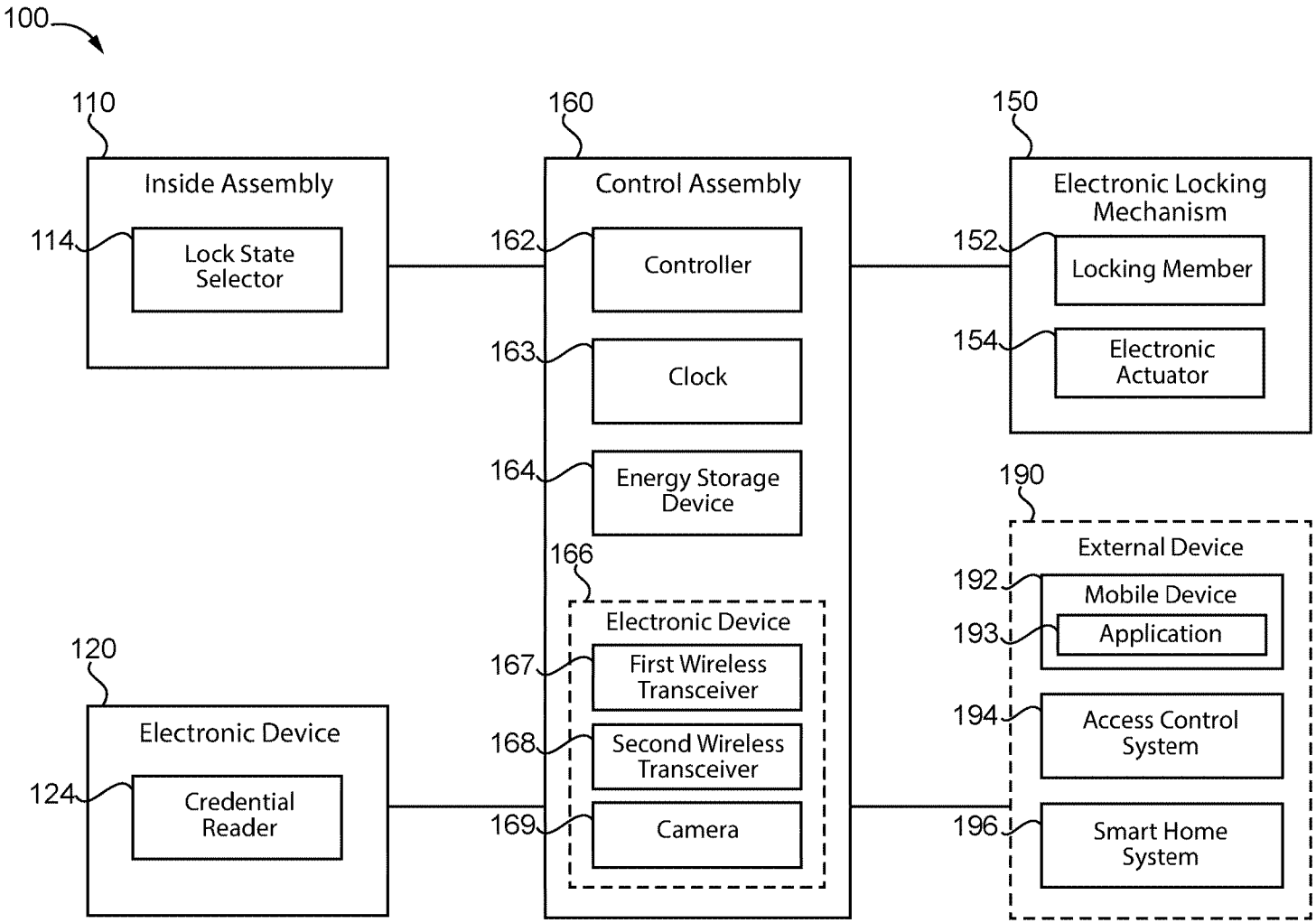
FIG. 2 is a schematic block diagram of the lockset illustrated in FIG. 1.

With additional reference to FIG. 2, the electronic locking mechanism 150 includes a locking member 152 having a locking position and an unlocking position, and an electronic actuator 154 operable to drive the locking member 152 between the locking position and the unlocking position to thereby adjust the locked/unlocked state of the lockset 100. In certain forms, the locking member 152 may be configured to selectively prevent the outside actuator 122 from retracting the bolt 142. As one example, the outside actuator 122 may be operably coupled with the bolt mechanism 140 such that rotation of the actuator 122 retracts the bolt 142, and the locking member 152 may prevent rotation of the actuator 122 when in the locking position. As another example, the outside actuator 122 may be selectively coupled with the bolt mechanism 140 via the locking member 152. In such forms, rotation of the actuator 122 may cause retraction of the bolt 142 when the locking member 152 is in its unlocking position, and the actuator 122 may freewheel without causing retraction of the bolt 142 when the locking member 152 is in its locking position. In further embodiments, the locking member 152 may be provided as the bolt 142 such that the locking mechanism 150 drives the bolt 142 between its extended locking position and its retracted unlocking position without requiring operation of either manual actuator 112, 122.

The control assembly 160 includes a controller 162, a clock 163, an energy storage device 164 such as a supercapacitor or battery, and at least one electronic device 166 operable to draw power from the energy storage device 164. It is also contemplated that the energy storage device 164 may be omitted, for example in embodiments in which the lockset 100 is configured for connection to line power. The electronic device 166 may, for example, include a first wireless transceiver 167 such as a Bluetooth transceiver, a second wireless transceiver 168 such as a Wi-Fi transceiver, and/or a camera 169. As described herein, the controller 162 is configured to selectively operate the electronic device 166 according to each of a higher-power schedule and a lower-power schedule based on historical usage of the lockset 100.

As will be appreciated, the electronic device 166 consumes more power when operated according to the higher-power schedule than when operated according to the lower-power schedule. In certain forms, the higher-power schedule may be a full-functionality schedule, in which the electronic device 166 operates to the fullest of its capabilities. In certain embodiments, the lower-power schedule may be a degraded-functionality schedule, in which some capabilities of the electronic device 166 are disabled or operated at a lower duty cycle. In certain embodiments, the lower-power schedule may involve disabling the electronic device.

While certain descriptions made hereinafter refer to a lower-power schedule and a higher-power schedule, it is to be appreciated that multiple levels of schedules may be used. For example, the available schedules may include a full-power schedule, a high-power schedule, a mid-power schedule, a low-power schedule, and a no-power schedule. As will be appreciated, the terms "higher-power" and "lower-power" are terms of degree that indicate that the higher-power schedule utilizes more power than the lower-power schedule. Thus, when the higher-power schedule is selected as the full-power schedule, the lower-power schedule may be any of the high-power schedule, the mid-power schedule, the low-power schedule, or the no-power schedule. Similarly, when the lower-power schedule is selected as the no-power schedule, the higher-power schedule may be selected as any of the full-power schedule, the high-power schedule, the mid-power schedule, or the low-power schedule.

In embodiments in which the electronic device 166 comprises a Bluetooth transceiver (e.g., as the wireless transceiver 167), the higher-power schedule may involve transmitting advertisements with a first periodicity, the lower-power schedule may involve transmitting the advertisements less frequently (i.e., with a lower duty cycle) than the advertisements are transmitted in the higher-power schedule. Those skilled in the art will readily appreciate that such a reduction in the frequency with which the advertisements are transmitted reduces the amount of power consumed by the transmission of advertisements. For example, reducing the frequency of transmission (i.e., increasing the periodicity) from every three seconds to every six seconds would equate to a power savings of fifty percent. In certain forms, the lower-power schedule may involve disabling the Bluetooth transceiver.

In embodiments in which the electronic device 166 comprises a Wi-Fi transceiver (e.g., as the wireless transceiver 168), the higher-power schedule may involve operating the Wi-Fi transceiver with a greater range and/or as an always-on transceiver. The lower-power schedule may involve operating the Wi-Fi transceiver with a lesser range and/or intermittently, or may involve disabling the transceiver.

In embodiments in which the electronic device 166 comprises a camera 169, the higher-power schedule may involve constantly recording video to record persons approaching the lockset 100. In such forms, the lower-power schedule may involve operating the camera with a lower duty cycle, for example by having the camera record in three-second bursts every ten seconds, or by having the camera take a single still image per second. It is also contemplated that the higher-power schedule may alternatively involve operating the camera 169 at a duty cycle less than 100% but greater than the duty cycle selected for the lower-power schedule. As one example, the higher-power schedule may involve capturing one image per second while the lower-power schedule involves capturing one image every two seconds or every three seconds.

While certain exemplary forms for the electronic device have been provided, it is to be appreciated that other forms of electronic device may be selectively operated according to higher-power and lower-power schedules based on historical use data. As one example, the lockset 100 may include a door position sensor in the form of a magnetometer that determines whether the door is closed or open based on the strength of a magnetic field generated by one or more magnets positioned in the strike. When operating according to the lower-power mode, the door position sensor may determine the door position less frequently than the door position is determined in the higher-power mode, thereby saving power. It is also contemplated that similar degradation may be applied to other types of sensors, such as passive infrared sensors. Similarly, the credential reader 124 may be placed in a lower-power sleep mode based on the historical usage data.

In certain forms, the control assembly 160 may be in communication with an external device 190, such as a mobile device 192, an access control system 194, and/or a smart home system 196. The control assembly 160 may, for example, be in communication with the external device 190 via one or both of the wireless transceivers 167, 168. When in communication with the external device 190, the control assembly 160 may transmit information to the external device 190 and/or receive information from the external device 190. Examples of information that may be transmitted from the lockset 100 to the external device 190 include, without limitation, audit information and information obtained by the camera 169 (e.g., photos and/or videos). In certain forms, the lockset 100 may be capable of livestreaming information from the camera 169 to the external device 190. Examples of information that may be transmitted from the external device 190 to the lockset 100 include, without limitation, updates and override schedules, which are described in further detail below.

Figure 3:
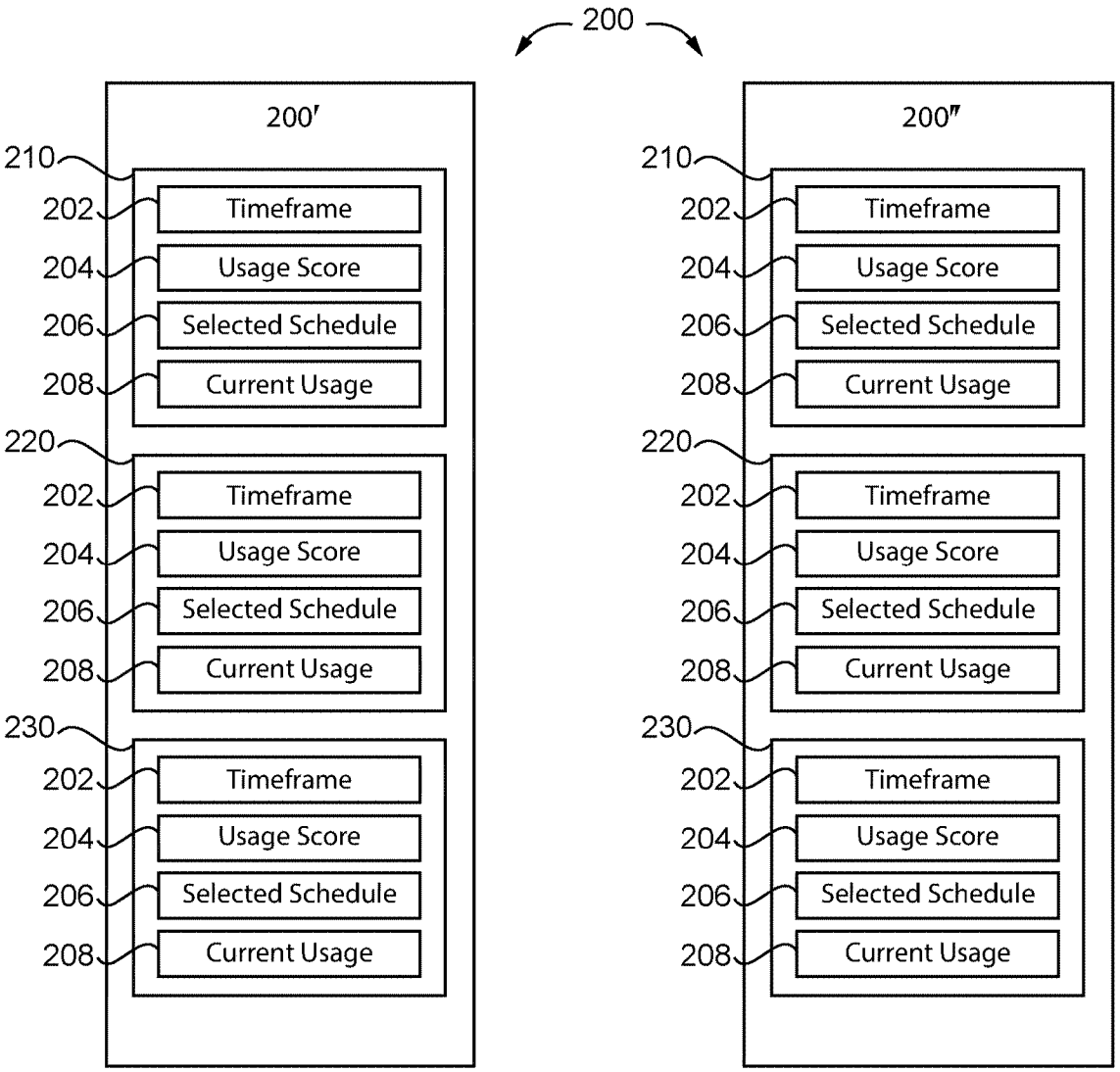
FIG. 3 illustrates two iterations of a recurring period of time, each of which includes a plurality of blocks.

With additional reference to FIG. 3, in order to determine when to operate the electronic device 166 according to the higher-power schedule and when to operate the electronic device 166 according to the lower-power schedule, the controller 162 monitors usage of the lockset 100 for at least one recurring period of time 200, such as a day or a week. The recurring period of time is divided into blocks, such as blocks of one hour or less, such that each iteration of the recurring period of time comprises the same set of blocks. While three blocks 210, 220, 230 are illustrated for ease and simplicity of description, it is to be appreciated that the recurring period of time 200 may be divided into a greater number of blocks. As one example, the recurring period of time 200 may be a week, and each block may have a duration of between ten and fifteen minutes. In certain forms, each block may be of the same duration, while in other forms, the blocks may be of varying durations. For example, blocks of shorter duration may be selected during daytime hours when greater granularity is desired, and blocks of longer duration may be selected during nighttime hours to reduce memory storage requirements. Additionally, while only a first iteration 200' and a second iteration 200" of the recurring period of time 200 are illustrated, it is to be appreciated that the processes described herein may take place over the course of more iterations of the recurring period of time 200. As described herein, each block 210, 220, 230 has associated therewith a plurality of block-specific parameters. In the illustrated form, the block-specific parameters include a timeframe 202, a usage score 204, a selected schedule 206, and a current usage 208.

Figure 4:
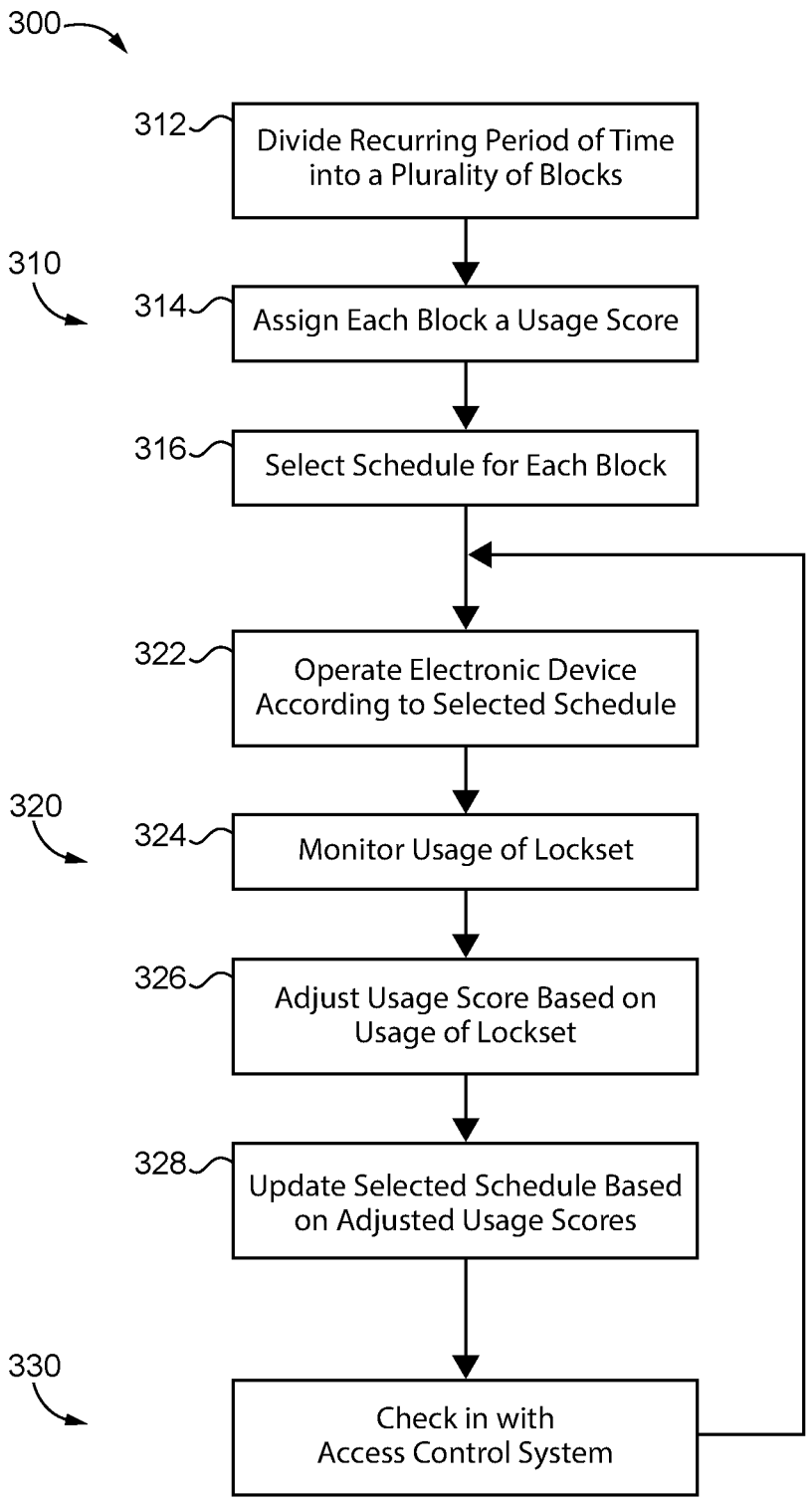
FIG. 4 is a schematic flow diagram of a process according to certain embodiments.

With additional reference to FIG. 4, illustrated therein is an exemplary process 300 that may be performed by and/or using the lockset 100. Operations illustrated for the processes in the present application are understood to be examples only, and operations may be combined or divided, and added or removed, as well as re-ordered in whole or in part, unless explicitly stated to the contrary. Unless specified to the contrary, it is contemplated that certain operations or steps performed in the process 300 may be performed wholly by one or more elements illustrated in the Figures (e.g., the lockset 100, the control assembly 160, and/or the external device 190), or that the operations or steps may be distributed among one or more of the elements and/or additional devices or systems that are not specifically illustrated in the Figures. Furthermore, while the operations are illustrated in a relatively serial manner, it is to be appreciated that some operations may be performed concurrently.

The process 300 may begin with a commissioning procedure 310, which generally involves an initial commissioning of the lockset 100. The commissioning procedure 310 may begin with an operation 312, which generally involves dividing a recurring period of time into a plurality of blocks, each having a corresponding timeframe 202 within the recurring period of time 200. As a result, each iteration of the recurring period of time 200 comprises the blocks, and each block corresponds to a recurring timeframe 202. For example, operation 312 may involve dividing the recurring period of time 200 into the three blocks 210, 220, 230. As a result, a first iteration 200' of the recurring period of time 200 comprises the three blocks 210, 220, 230, as does a second iteration 200" of the recurring period of time 200. More particularly, the first iteration 200' of the recurring period of time 200 includes a first iteration of the three blocks 210, 220, 230, and the second iteration 200" of the recurring period of time 200 includes a second iteration of the three blocks 210, 220, 230.

While three blocks 210, 220, 230 are illustrated for ease and simplicity of description, it is to be appreciated that the recurring period of time 200 may be divided into a greater number of blocks. For example, in embodiments in which the duration selected for the recurring period of time 200 is one week and the duration selected for each block is one hour, the recurring period of time 200 would be divided into one hundred sixty-eight (168) blocks. Those skilled in the art will readily appreciate that decreasing the duration selected for the blocks while retaining the same duration for the recurring period of time 200 would increase the number of blocks in each recurring period of time. For example, selecting a recurring period of time 200 with a duration of one week and selecting a duration for each block of fifteen minutes would result in each recurring period of time 200 being divided into six hundred seventy-two (672) blocks.

For ease and convenience of description, an earlier iteration of the recurring period of time 200 is referred to herein as the first iteration 200' of the recurring period of time 200, and a later iteration of the recurring period of time 200 is referred to as the second iteration 200" of the recurring period of time. It should be appreciated, however, the other iterations of the recurring period of time 200 may take place before the first iteration 200' and between the first iteration 200' and the second iteration 200". Thus, the first and second iterations 200', 200" of the recurring period of time need not be sequential. Similarly, while the blocks 210, 220, 230 may be referred to herein as the first block 210, the second block 220, and the third block 230, it is to be appreciated that the blocks 210, 220, 230 need not be sequential.

The commissioning procedure 310 also includes an operation 314, which generally involves assigning each block an initial usage score 204. The initial usage score 204 may, for example, be assigned a value between zero (indicating no usage) and one (indicating high or maximum usage). In certain forms, operation 314 may involve assigning each block the same usage score 204, such as a value of one, or a value ranging between a predetermined threshold value and one. In other forms, operation 314 may involve assigning the blocks different scores, for example based on anticipated usage during the block. By way of illustration, if it is anticipated that usage of the lockset 100 will be greater during the first block 210 than during the second block 220, operation 314 may involve assigning the first block 210 a greater usage score 204 than is assigned to the second block 220.

The commissioning procedure also includes an operation 316, which generally involves selecting a schedule 206 for each block. In certain forms, operation 316 may involve selecting the higher-power schedule for each block, such as in embodiments in which each block is assigned a usage score of one and/or embodiments in which each block is assigned a usage score exceeding a predetermined usage score threshold. In other forms, operation 316 may involve selecting the lower-power schedule for one or more blocks, for example in embodiments in which one or more blocks is initially assigned a usage score below the predetermined usage score threshold.

The process 300 also includes an operating procedure 320, which generally involves operating the lockset 100. Each iteration of the operating procedure 320 corresponds to a respective one of the blocks, and occurs at least in part during the timeframe 202 defined for the corresponding block. As should be appreciated, the controller 162 may determine to perform the operating procedure 320 in connection with a particular block based on information from the clock 163 indicating that the current time is one that falls within the timeframe 202 for that particular block. While one iteration of the operating procedure 320 is described herein as relating to the first block 210, the next iteration of the operating procedure 320 may correspond to the second block 220, and a subsequent iteration of the operating procedure 320 may correspond to the third block 230. As will be appreciated, a subsequent iteration of the operating procedure 320 may again relate to the first block 210, which recurs during the next iteration (e.g., the second iteration 200") of the recurring period of time 200.

The operating procedure 320 includes an operation 322, which generally involves operating the electronic device 166 according to the block-specific schedule 206 selected for the block. For example, in embodiments in which the initially-selected schedule 206 for the first block 210 is the higher-power schedule, a first iteration of operation 322 corresponding to the first block 210 would involve operating the electronic device 166 according to the higher-power schedule during the timeframe 202 associated with the first block 210.

The operating procedure 320 further includes an operation 324, which generally involves monitoring usage of the lockset 100 during the timeframe 202 associated with the corresponding block, and generating the current usage parameter 208 based on the usage. In certain forms, operation 324 may involve monitoring the general usage of the lockset 100, for example by monitoring a sensor that indicates how often the lockset 100 is operated. Such sensors may, for example, include one or more of a request-to-exit (RX) sensor monitoring usage of the inside actuator 112, a request-to-enter sensor monitoring usage of the outside actuator 122, a door position sensor (DPS) monitoring the position of the door 80, a latchbolt position monitor (LX) sensing the position of the latchbolt 142, and/or a credential use sensor monitoring usage of the credential reader 124. As described herein, in certain embodiments, operation 324 may involve monitoring a specific usage of the lockset 100. For example, operation 324 may involve monitoring the usage of the electronic device 166 itself. The current usage parameter 208 may be normalized to the scale selected for the usage score (e.g., ranging from zero to one).

The operating procedure 320 further includes an operation 326, which generally involves adjusting the block-specific usage score 204 for the corresponding block (e.g., the first block 210) based on the block-specific current usage parameter 208. In other words, operation 326 generally involves generating an adjusted usage score based on the existing block-specific usage score 204 and the current usage parameter 208 generated in operation 324. For example, operation 326 may involve increasing the usage score 204 when the current usage parameter 208 is greater than the usage score 204, and decreasing the usage score 204 when the current usage parameter 208 is less than the usage score 204.

The existing usage score 204 and the current usage parameter 208 may be assigned relative weights to provide for a desired degree of sensitivity to changes in usage. For example, when historical trends are to be weighted higher than more recent fluctuations, the existing usage score 204 may be weighted relatively highly while the current usage parameter 208 is weighted relatively lowly. Conversely, should it be desired to weigh recent trends more highly than past historical trends, the existing usage score 204 may be weighted relatively lowly while the current usage parameter 208 is weighted relatively highly.

The operating procedure 320 further includes an operation 328, which generally involves updating the block-specific selected schedule 206 for the block (e.g., the first block 210) based on the block-specific adjusted usage score 204 for the corresponding block (e.g., the first block 210). Operation 328 may involve selecting the higher-power schedule when the adjusted usage score 204 for the corresponding block satisfies a first criterion, and selecting the lower-power schedule when the adjusted usage score 204 for the corresponding block satisfies a second criterion. By way of example, satisfaction of the first criterion may involve the block-specific usage score 204 exceeding a threshold usage score, and satisfaction of the second criterion may involve the block-specific usage score 204 falling below the threshold usage score. In certain forms, operation 328 may involve selecting a no-power schedule when the adjusted usage score 204 for block 210 satisfies a third criterion, for example by falling below a second threshold usage score. As will be appreciated, the schedule selected in operation 328 serves as the selected schedule 206 for the next iteration of the operating procedure 320 that corresponds to the same block (e.g., the iteration of the operating procedure 320 that occurs in the immediately subsequent iteration of the recurring period of time 200 and corresponds to the first block 210).

The process 300 may further include a check-in procedure 330, which generally involves activating one of the wireless transceivers 167, 168 to check in with the access control system 194. In certain forms, the check-in procedure 330 may be performed regardless of the schedule under which the electronic device 166 is operated in the operating procedure 320. For example, if the Wi-Fi transceiver is operated according to a no-power schedule in the operating procedure 320, the Wi-Fi transceiver may nonetheless be activated to check in with the access control system 194 at some point during the timeframe 202 for the first block 210.

During the check-in procedure 330, the lockset 100 may communicate with an external device 190. As one example, the lockset 100 may transmit to the external device 190 audit information and/or information (e.g., images and/or videos) obtained by the camera 169 during the timeframe 202 corresponding to the first block 210. As another example, the lockset 100 may receive from the external device 190 updates and/or new schedule information. For example, the access control system 194 may be operable to selectively override the selected schedule 202 for one or more blocks, such as in response to a request from a user or based on information available to the smart home system 196.

Following the performance of the operating procedure 320 for the first block 210, the operating procedure 320 may be performed in association with the second block 220. As a result of operation 322, during the timeframe 202 associated with the second block 220, the electronic device 166 is operated according to the schedule 206 selected for the second block 220. Additionally, usage of the lockset 100 during the timeframe 202 associated with the second block 220 is monitored in operation 324, and a current usage parameter 208 for the second block 220 is generated. The usage score 204 for the second block 220 is adjusted in operation 326, and the selected schedule 206 for the second block 220 is updated based on the adjusted usage score 204 in operation 328. The check-in procedure 330 may then be reiterated, and the operating procedure 320 may be reiterated for the third block 230.

Once the operating procedure 320 has been iterated for each block in the recurring period of time 200, the first iteration 200' may be completed, and another iteration such as the second iteration 200" may begin. During the second iteration 200", the operating procedure 320 for the first block 210 is performed using the usage score 204 and selected schedule 206 as those parameters were adjusted and/or updated in the prior iteration of the operating procedure 320 for the first block 210. Similarly, the operating procedure 320 for the second and third blocks 220, 230 are performed using the usage score 204 and selected schedule 206 as those parameters were adjusted and/or updated in the prior iteration of the operating procedure 320 for the second and third blocks 220 and 230. As a result, the power usage of the lockset 100 is dynamically adjusted based on historical trends, thereby conserving battery life while minimizing the adverse effects on the functionality of the lockset 100.

While certain aspects of the process 300 have been described with reference to a single electronic component 166, it is to be appreciated that the process 300 may involve controlling the operation of more than one electronic component 166. In such forms, the usage score 204, the selected schedule 206, and the current usage 208 for each block may each comprise plural individual component-specific parameters, each relating to a corresponding and respective one of a plurality of electronic components 166. By way of example, the usage score 204, the selected schedule 206, and the current usage 208 may each include individual component-specific parameters for the first wireless transceiver 167 and the second wireless transceiver 168.

By way of illustration, if during one or more iterations of the operating procedure 320 for a particular block it is determined that the first wireless transceiver 167 is used frequently and the second wireless transceiver 168 is used far less frequently, the current usage parameter 208 may include a high value component-specific current usage parameter 208 for the first transceiver 167 and a low value component-specific current usage parameter 208 for the second transceiver 168, and the corresponding component-specific parameters within the usage score 204 for that block may be adjusted accordingly. Should the appropriate criteria be satisfied in operation 328, the schedule 206 may be selected to include the higher-power schedule for the first transceiver 167 and the lower-power schedule for the second transceiver 168 such that the transceivers 167, 168 operate according to the corresponding parameters of the schedule 202 in the following iteration of the operating procedure 320 that corresponds to the block.

In certain embodiments, a component-specific current usage parameter 208 generated during operation 324 may be based on the usage of the component itself, for example in embodiments in which the power usage of a particular component corresponds to usage of the component. For example, a wireless transceiver 167 such as a Bluetooth transceiver may consume more power when it is being used to transmit and/or receive information. Thus, a component-specific usage score 204 and/or usage parameter 208 for a wireless transceiver 167 may be based at least in part upon the power consumed by the wireless transceiver 167.

In certain embodiments, a component-specific current usage parameter 208 generated during operation 324 may be based on the usage of another component or on the usage of the lockset 100 as a whole, for example in embodiments in which the power usage of a particular component depends primarily on the duty cycle with which the component is operated. By way of example, if the current usage parameter 208 for the camera 169 were generated based only upon the power usage of the camera 169, the usage score 204 may remain relatively constant. More specifically, the usage score 204 would remain high when the camera 169 is operated according to the higher-power schedule, and would remain low when the camera 169 is operated according to the lower-power schedule. For components of this type, the current usage parameter 208 may be based on usage of other components and/or on additional criteria.

As one example, a component-specific current usage parameter 208 for a camera 169 may be generated based on overall usage of the lockset 100 during the corresponding block, as greater usage of the lockset 100 corresponds to a greater utility for higher-granularity information from the camera 169. As another example, a component-specific usage parameter 208 for the camera 169 may be based on movement detected within the video shot by the camera 169, as less movement corresponds to a lower utility for high-granularity information from the camera 169.

As another example, a component-specific current usage parameter 208 for a door position sensor (DPS) such as a magnetometer may be based on overall usage of the lockset 100 during the corresponding block, as greater usage of the lockset 100 corresponds to a greater utility for higher-granularity information from the door position sensor (DPS). As another example, a component-specific usage parameter 208 for the DPS may be based on the number of times the signal generated by the DPS transitions between a closed-door signal and an open-door signal, as less movement of the door corresponds to a lower utility for high-granularity information from the DPS.

As noted above, the access control system 194 may be operable to provide an override instruction that overrides the selected schedule for a particular block. Additionally or alternatively, the lockset 100 itself may provide an override schedule for a particular block based upon usage of the lockset 100. For example, the lockset 100 may override the lower-power schedule with the higher-power schedule for a predetermined period of time following operation of the lockset 100. By way of illustration, when the lockset 100 is operating the electronic device 166 according to the lower-power schedule and the lockset 100 is actuated (for example as sensed by a door position sensor, a request to exit sensor, or another sensor), the lockset 100 may operate the electronic device 166 according to the higher-power schedule for the next thirty minutes to provide greater functionality in the event that the user again wishes to interact with the lockset 100. Thus, if the user returns within the next half-hour, the lockset 100 will still be operating the electronic device 166 according to the higher power schedule in anticipation of the user's return.

For purposes of illustration, an exemplary use case scenario will now be described with reference to the process 300. In the commissioning procedure 310, the recurring period of time 200 is selected as one week, and blocks of one-hour duration are selected. Thus, each block has an associated timeframe 202 that can be expressed as the day of the week and the start of the hour (e.g., Tuesday 8 AM, Friday 2 PM, etc.) Each daytime block is initially assigned a usage score 202 of one, and each nighttime block is initially assigned a usage score that is less than one but above the predetermined threshold usage score. For the first four weeks, the lockset 100 is not interacted with by a user during nighttime hours or on Sundays, thereby causing the usage scores 204 for the corresponding blocks to decrease. The usage score 204 for the nighttime blocks falls below the threshold usage score following the second week, and the lockset 100 starts operating the electronic component 166 according to the lower-power schedule during nighttime blocks starting on the third week. Similarly, the usage score for the Sunday daytime hours falls below the threshold usage score following the fourth week, and the lockset 100 starts operating the electronic component 166 according to the lower-power schedule during Sunday daytime hours starting on the fifth week.

With continued reference to the example use case scenario, the first wireless transceiver 167 is provided as a Bluetooth transceiver, and the second wireless transceiver 168 is provided as a Wi-Fi transceiver. During the first four weeks, the lockset 100 is frequently operated during the Tuesday 8 AM block. The typical user during the Tuesday 8 AM block presents his or her credential by transmitting the credential from a mobile device 192 via the Bluetooth transceiver 167, for example using an app 193 installed to the mobile device 192. As a result, the block-specific and component-specific usage score 204 corresponding to the Bluetooth transceiver 167 and the Tuesday 8 AM block remains high, as does the block-specific and component-specific usage score 204 for the camera 169 and the Tuesday 8 AM block. However, the Wi-Fi transceiver 168 is used infrequently during the Tuesday 8 AM block, such that the block-specific and component-specific usage score 204 relating to the Wi-Fi transceiver 168 and the Tuesday 8 AM block falls below the threshold value following the fourth iteration of the Tuesday 8 AM block. When the fifth Tuesday 8 AM block occurs, the lockset 100 therefore operates the Wi-Fi transceiver 168 according to the lower-power schedule (e.g., by disabling the transceiver 168), while continuing to operate the Bluetooth transceiver 167 and the camera 169 according to the higher-power schedule. During the fifth iteration of the Tuesday 8 AM block, the user may attempt to form a wireless connection between the mobile device 192 and the lockset 100 via the Wi-Fi transceiver 168. When this occurs, the app 193 on the mobile device 192 informs the user that the performance of the lockset 100 has been degraded to conserve battery, and that communication with the lockset 100 may be obtained via the Bluetooth transceiver 167. Additionally or alternatively, such information may be indicated by the lockset 100 itself, for example via a display and/or indicators.

Continuing the use case scenario, the user may determine that a package is set to be delivered the during the following Tuesday 8 AM block. The user causes the access control system 194 to transmit to the lockset 100 an override instruction, for example during a time when the Wi-Fi transceiver 168 is being operated according to the higher-power schedule and/or during one of the check-in procedures 330. Responsive to the override instruction, the lockset 100 updates the schedule 204 for the following Tuesday 8 AM block to select the higher-power schedule for the Wi-Fi transceiver 168. The user is thus able to view a livestream from the camera 169 to watch for the delivery personnel via the smart home system 166. When the delivery arrives, the user may remotely cause the lockset 100 to transition to the unlocked state to permit the delivery personnel to place the package inside the home, and may thereafter remotely return the lockset 100 to its locked state.

In certain forms, the user may not need to instruct the access control system 194 to perform the override. For example, the lockset 100 may be integrated with a smart home system 196 such as Amazon Key such that the access control system 194 has access to information indicating that a delivery from Amazon is scheduled to arrive during the Tuesday 8 AM block. In such forms, the access control system 194 may provide the override instruction to the lockset 100 without requiring input from the user.

With continued reference to the example use-case scenario, as noted above, the lockset 100 operates the electronic device 166 (e.g., the Bluetooth transceiver 167) according to the lower-power schedule on Sundays. On one such Sunday during the 11 AM block, the user exits her home via the door 80, thereby utilizing the lockset 100. This use is detected by the DPS or the RX sensor, and is taken into account for future calculations regarding the schedule to be selected for future Sunday 11 AM blocks. Additionally, based upon the lockset 100 being used in the current Sunday 11 AM block, the lockset 100 overrides the lower-power schedule selected for the current Sunday 11 AM block, and instead operates the wireless transceiver 167 according to the higher-power schedule for the remainder of the Sunday 11 AM block and the entirety of the following 12 PM block. Thus, when the user returns, the lockset 100 is operating the wireless transceiver 167 at full power in anticipation of the user's return. The user can therefore utilize her mobile device 198 to unlock the lockset 100 upon her return, despite the fact that the wireless transceiver 167 would have been operated according to the lower-power schedule but for the operation of the lockset 100.

Figure 5:
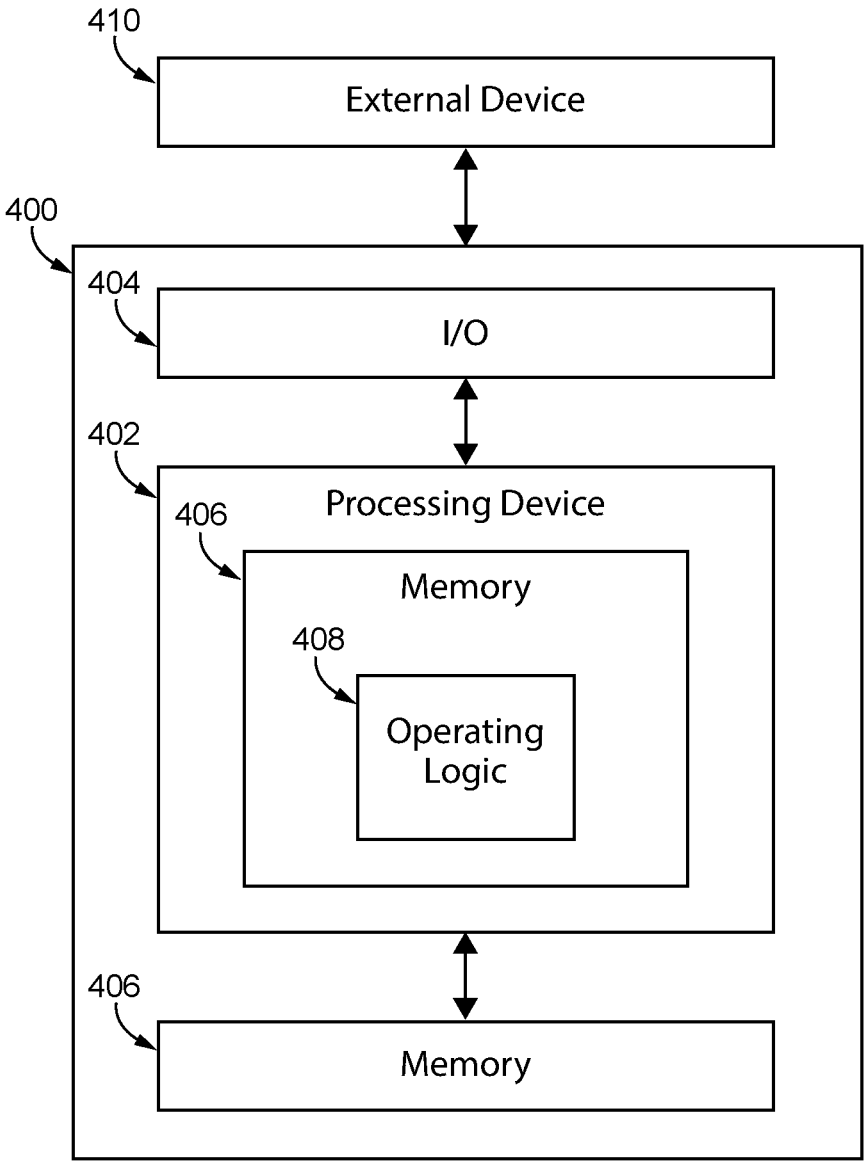
FIG. 5 is a schematic block diagram of a computing device.

Referring now to FIG. 5, a simplified block diagram of at least one embodiment of a computing device 400 is shown. The illustrative computing device 400 depicts at least one embodiment of a lockset, control assembly, or controller that may be utilized in connection with the lockset 100, the control assembly 160, and/or the controller 162 illustrated in FIGS. 1 and 2.

Depending on the particular embodiment, the computing device 400 may be embodied as a server, desktop computer, laptop computer, tablet computer, notebook, netbook, Ultrabook™ mobile computing device, cellular phone, smartphone, wearable computing device, personal digital assistant, Internet of Things (IoT) device, reader device, access control device, control panel, processing system, router, gateway, and/or any other computing, processing, and/or communication device capable of performing the functions described herein.

The computing device 400 includes a processing device 402 that executes algorithms and/or processes data in accordance with operating logic 408, an input/output device 404 that enables communication between the computing device 400 and one or more external devices 410, and memory 406 which stores, for example, data received from the external device 410 via the input/output device 404.

The input/output device 404 allows the computing device 400 to communicate with the external device 410. For example, the input/output device 404 may include a transceiver, a network adapter, a network card, an interface, one or more communication ports (e.g., a USB port, serial port, parallel port, an analog port, a digital port, VGA, DVI, HDMI, FireWire, CAT 5, or any other type of communication port or interface), and/or other communication circuitry. Communication circuitry may be configured to use any one or more communication technologies (e.g., wireless or wired communications) and associated protocols (e.g., Ethernet, Bluetooth®, Bluetooth Low Energy (BLE), Wi-Fi®, WiMAX, etc.) to effect such communication depending on the particular computing device 400. The input/output device 404 may include hardware, software, and/or firmware suitable for performing the techniques described herein.

The external device 410 may be any type of device that allows data to be inputted or outputted from the computing device 400. For example, in various embodiments, the external device 410 may be embodied as the lockset 100, the control assembly 160, the controller 162, and/or the external device 190 (e.g. the mobile device 192 or the access control system 194). Further, in some embodiments, the external device 410 may be embodied as another computing device, switch, diagnostic tool, controller, printer, display, alarm, peripheral device (e.g., keyboard, mouse, touch screen display, etc.), and/or any other computing, processing, and/or communication device capable of performing the functions described herein. Furthermore, in some embodiments, it should be appreciated that the external device 410 may be integrated into the computing device 400.

The processing device 402 may be embodied as any type of processor(s) capable of performing the functions described herein. In particular, the processing device 402 may be embodied as one or more single or multi-core processors, microcontrollers, or other processor or processing/controlling circuits. For example, in some embodiments, the processing device 402 may include or be embodied as an arithmetic logic unit (ALU), central processing unit (CPU), digital signal processor (DSP), and/or another suitable processor(s). The processing device 402 may be a programmable type, a dedicated hardwired state machine, or a combination thereof. Processing devices 402 with multiple processing units may utilize distributed, pipelined, and/or parallel processing in various embodiments. Further, the processing device 402 may be dedicated to performance of just the operations described herein, or may be utilized in one or more additional applications. In the illustrative embodiment, the processing device 402 is of a programmable variety that executes algorithms and/or processes data in accordance with operating logic 408 as defined by programming instructions (such as software or firmware) stored in memory 406. Additionally or alternatively, the operating logic 408 for processing device 402 may be at least partially defined by hardwired logic or other hardware. Further, the processing device 402 may include one or more components of any type suitable to process the signals received from input/output device 404 or from other components or devices and to provide desired output signals. Such components may include digital circuitry, analog circuitry, or a combination thereof.

The memory 406 may be of one or more types of non-transitory computer-readable media, such as a solid-state memory, electromagnetic memory, optical memory, or a combination thereof. Furthermore, the memory 406 may be volatile and/or nonvolatile and, in some embodiments, some or all of the memory 406 may be of a portable variety, such as a disk, tape, memory stick, cartridge, and/or other suitable portable memory. In operation, the memory 406 may store various data and software used during operation of the computing device 400 such as operating systems, applications, programs, libraries, and drivers. It should be appreciated that the memory 406 may store data that is manipulated by the operating logic 408 of processing device 402, such as, for example, data representative of signals received from and/or sent to the input/output device 404 in addition to or in lieu of storing programming instructions defining operating logic 408. As illustrated, the memory 406 may be included with the processing device 402 and/or coupled to the processing device 402 depending on the particular embodiment. For example, in some embodiments, the processing device 402, the memory 406, and/or other components of the computing device 400 may form a portion of a system-on-a-chip (SoC) and be incorporated on a single integrated circuit chip.

In some embodiments, various components of the computing device 400 (e.g., the processing device 402 and the memory 406) may be communicatively coupled via an input/output subsystem, which may be embodied as circuitry and/or components to facilitate input/output operations with the processing device 402, the memory 406, and other components of the computing device 400. For example, the input/output subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

The computing device 400 may include other or additional components, such as those commonly found in a typical computing device (e.g., various input/output devices and/or other components), in other embodiments. It should be further appreciated that one or more of the components of the computing device 400 described herein may be distributed across multiple computing devices. In other words, the techniques described herein may be employed by a computing system that includes one or more computing devices. Additionally, although only a single processing device 402, I/O device 404, and memory 406 are illustratively shown in FIG. 5, it should be appreciated that a particular computing device 400 may include multiple processing devices 402, I/O devices 404, and/or memories 406 in other embodiments. Further, in some embodiments, more than one external device 410 may be in communication with the computing device 400.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method of operating a lockset during a plurality of iterations of a recurring period of time, wherein each iteration of the recurring period of time comprises a plurality of blocks, and wherein the lockset includes a first powered component and at least one other powered component, the method comprising:

determining a corresponding component-specific usage score of a particular block of the plurality of blocks for each of the at least one other powered component based on usage of the corresponding at least one other powered component during the particular block in a particular iteration of the recurring period of time;

for the particular block, selecting a block-specific schedule for the first powered component based on the corresponding component-specific usages scores of the particular block by:

selecting the block-specific schedule as a higher-power schedule in response to the corresponding component-specific usage scores satisfying a first criterion; and selecting the block-specific schedule as a lower-power schedule in response to the corresponding usage scores satisfying a second criterion different from the first criterion; and during a subsequent iteration of the recurring period of time, operating the first powered component during the particular block according to the block-specific schedule.

2. The method of claim 1, further comprising adjusting a component-specific usage score of the first powered component of the particular block based on the usage of the corresponding at least one other powered component during the particular block in the particular iteration of the recurring period of time.

3. The method of claim 1, wherein the first powered component comprises a wireless transceiver.

4. The method of claim 3, wherein the first powered component comprises a Wi-Fi transceiver.

5. The method of claim 3, wherein operating the first powered component according to the higher-power schedule comprises transmitting wireless communications at a first rate; and wherein operating the first powered component according to the lower-power schedule comprises transmitting wireless communications at a second rate different from the first rate.

6. The method of claim 1, wherein the lower-power schedule comprises a no-power schedule.

7. The method of claim 1, wherein the at least one other powered component comprises at least one of a request-to-exit sensor, a request-to-enter sensor, a door position sensor, a latchbolt position monitor, or a credential use sensor.

8. A lockset, comprising:

a first powered component;

at least one other powered component;

a processor circuitry that executes during at least a portion of a plurality of iterations of a recurring period of time, wherein each iteration of the recurring period of time comprises a plurality of blocks; and a memory comprising a plurality of instructions stored thereon that, in response to execution by the processor circuitry, causes the lockset to:

determine a corresponding component-specific usage score of a particular block of the plurality of blocks for each of the at least one other powered component based on usage of the corresponding at least one other powered component during the particular block in a particular iteration of the recurring period of time;

select, for the particular block, a block-specific schedule for the first powered component based on the corresponding component-specific usages scores of the particular block by (i) selecting the block-specific schedule as a higher-power schedule in response to the corresponding component-specific usage scores satisfying a first criterion and (ii) selecting the block-specific schedule as a lower-power schedule in response to the corresponding usage scores satisfying a second criterion different from the first criterion; and operate, during a subsequent iteration of the recurring period of time, the first powered component during the particular block according to the block-specific schedule.

9. The lockset of claim 8, wherein the plurality of instructions further causes the lockset to adjust a component-specific usage score of the first powered component of the particular block based on the usage of the corresponding at least one other powered component during the particular block in the particular iteration of the recurring period of time.

10. The lockset of claim 8, wherein the first powered component comprises a wireless transceiver.

11. The lockset of claim 10, wherein the first powered component comprises a Wi-Fi transceiver.

12. The lockset of claim 10, wherein to operate the first powered component according to the higher-power schedule comprises to transmit wireless communications at a first rate; and wherein to operate the first powered component according to the lower-power schedule comprises to transmit wireless communications at a second rate different from the first rate.

13. The lockset of claim 8, wherein the lower-power schedule comprises a no-power schedule.

14. The method of claim 8, wherein the at least one other powered component comprises at least one of a request-to-exit sensor, a request-to-enter sensor, a door position sensor, a latchbolt position monitor, or a credential use sensor.

15. A method of operating a lockset during a plurality of iterations of a recurring period of time, wherein each iteration of the recurring period of time comprises a plurality of blocks, and wherein the lockset includes a powered component, the method comprising:

determining a usage score of a particular block of the plurality of blocks based on usage of the lockset during the particular block in a particular iteration of the recurring period of time;

for the particular block, selecting a block-specific schedule for the powered component based on the usage score of the particular block by:

selecting the block-specific schedule as a higher-power schedule in response to the usage score of the particular block satisfying a first criterion; and selecting the block-specific schedule as a lower-power schedule in response to the usage score of the particular block satisfying a second criterion different from the first criterion; and during a subsequent iteration of the recurring period of time, operating the powered component during the particular block according to the block-specific schedule.

16. The method of claim 15, further comprising adjusting the usage score of the particular block based on usage of the lockset during the particular block in the particular iteration of the recurring period of time.

17. The method of claim 15, wherein the powered component comprises at least one component of a credential reader.

18. The method of claim 15, wherein the powered component comprises a sensor.

19. The method of claim 15, wherein the powered component comprises a wireless transceiver;

wherein operating the powered component according to the higher-power schedule comprises transmitting wireless communications at a first rate; and wherein operating the powered component according to the lower-power schedule comprises transmitting wireless communications at a second rate different from the first rate.

20. The method of claim 19, wherein the wireless communications are associated with a check-in procedure.

* * * * *